US009404328B2

(12) United States Patent
Johnson

(10) Patent No.: US 9,404,328 B2
(45) Date of Patent: Aug. 2, 2016

(54) GAS INJECTION FOR MANAGED PRESSURE DRILLING

(75) Inventor: Ashley Bernard Johnson, Milton (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 199 days.

(21) Appl. No.: 14/117,002

(22) PCT Filed: Jun. 29, 2012

(86) PCT No.: PCT/IB2012/053335

§ 371 (c)(1),
(2), (4) Date: Nov. 11, 2013

(87) PCT Pub. No.: WO2013/001512

PCT Pub. Date: Jan. 3, 2013

(65) Prior Publication Data

US 2014/0076636 A1 Mar. 20, 2014

Related U.S. Application Data

(60) Provisional application No. 61/503,280, filed on Jun. 30, 2011.

(51) Int. Cl.
*E21B 21/08* (2006.01)
*E21B 21/16* (2006.01)

(52) U.S. Cl.
CPC ..... *E21B 21/16* (2013.01)

(58) Field of Classification Search
CPC ..... E21B 7/00; E21B 7/12; E21B 21/00; E21B 21/08
See application file for complete search history.

(56) References Cited

U.S. PATENT DOCUMENTS

| | | | | |
|---|---|---|---|---|
| 7,886,849 | B2 * | 2/2011 | Williams | C09K 8/38 166/332.1 |
| 2003/0217849 | A1 | 11/2003 | Hosie et al. | |
| 2005/0269134 | A1 * | 12/2005 | Strazhgorodskiy | E21B 21/00 175/57 |
| 2006/0157282 | A1 | 7/2006 | Tilton et al. | |
| 2007/0193778 | A1 | 8/2007 | Wooten | |
| 2011/0061872 | A1 | 3/2011 | Mix et al. | |

OTHER PUBLICATIONS

International Search Report of PCT Application No. PCT/IB2012/053335 dated Mar. 11, 2013: pp. 1-5.

Mykytiw et al., "IADC/SPE 81631: Design and Operational Considerations to Maintain Underbalanced Conditions with Concentric Casing Injection," SPE International, 2003: pp. 1-11.

* cited by examiner

*Primary Examiner* — William P Neuder

(57) ABSTRACT

Injection of gas into a managed pressure drilling system to provide for operation of the drilling system in a pressure window defined by the pore pressure of a formation being drilled and a fracture pressure of the formation. The gas is injected through gas injection ports and drilling fluids are allowed to flow between the drilling annulus and the gas injection system though a plurality of flow ports that are disposed vertically below the gas injection ports in the borehole being drilled. The gas injection ports and the flow ports are configured so that when gas is flowing through the gas injection ports, the flow ports are sealed.

30 Claims, 3 Drawing Sheets

GAS INJECTION FOR MANAGED PRESSURE DRILLING

CROSS-REFERENCE TO RELATED APPLICATIONS

This application is a U.S. National Stage Application under 35 U.S.C. §371 and claims priority to Patent Cooperation Treaty Application No. PCT/IB2012/053335 filed Jun. 29, 2012, which claims the benefit of U.S. Provisional Patent Application Ser. No. 61/503280 filed Jun. 30, 2011; both of these applications are incorporated herein by reference in their entireties.

BACKGROUND OF THE DISCLOSURE

The present invention relates to gas injection procedures for use in drilling a subterranean borehole, particularly, but not exclusively, for the purpose of extracting hydrocarbons from a subterranean reservoir.

The drilling of a borehole is typically carried out using a steel pipe known as a drillstring with a drill bit on the lowermost end. The entire drillstring may be rotated using an overground drilling motor, or the drill bit may be rotated independently of the drillstring using a fluid powered motor or motors mounted in the drillstring just above the drill bit. As drilling progresses, a flow of drilling fluid is used to carry the debris created by the drilling process out of the wellbore. The drilling fluid is pumped through an inlet line down the drillstring to pass through the drill bit, and returns to the surface via an annular space between the outer diameter of the drillstring and the borehole (generally referred to as the annulus).

Drilling fluid is a broad drilling term that may cover various different types of drilling fluids. The term 'drilling fluid' may be used to describe any fluid or fluid mixture used during drilling and may cover such things as air, nitrogen, misted fluids in air or nitrogen, foamed fluids with air or nitrogen, aerated or nitrified fluids to heavily weighted mixtures of oil or water with solid particles.

The drilling fluid flow through the drillstring may be used to cool the drill bit. In conventional overbalanced drilling, the density of the drilling fluid is selected so that it produces a pressure at the bottom of the borehole (the "bottom hole pressure" or "BHP"), which is high enough to counter-balance the pressure of fluids in the formation ("the formation pore pressure"). By counter-balancing the pore pressure, the BHP acts to prevent the inflow of fluids from the formations surrounding the borehole. However, if the BHP falls below the formation pore pressure, formation fluids, such as gas, oil and/or water may enter the borehole and produce what is known in drilling as a kick. By contract, if the BHP is very high, the BHP may be higher than the fracture strength of the formation surrounding the borehole resulting in fracturing of the formation. When the formation is fractured, the drilling fluid may enter the formation and be lost from the drilling process. This loss of drilling fluid from the drilling process may causes a reduction in BHP and as a consequence cause a kick as the BHP falls below the formation pore pressure.

In order to overcome the problems of kicks and/or fracturing of formations during drilling, a process known as managed pressure drilling has been developed. In managed pressure drilling various techniques may be used to control the BHP during the drilling process. One such method comprises injecting gas into the mud column in the drilling annulus to reduce the BHP produced by the column of the mud in the drilling annulus.

SUMMARY

In one embodiment, a method for injecting gas into a drilling annulus surrounding a drillstring during a drilling process is provided. The drilling process is a process for drilling a borehole into a subterranean formation. The drilling annulus comprises an annular space between the drillstring and a casing string. The drillstring extends from a surface location down the borehole, and a bottomhole assembly, which includes a drill bit, is coupled with the lower end of the drillstring. The drill bit is used to drill the borehole. During the drilling process, drilling fluids are circulated down the drillstring through the drill bit and up the drilling annulus.

In the embodiment of the present invention, gas is pumped into a gas injector pipe into the drilling annulus to reduce the BHP produced at least in part by the column of drilling fluid in the drilling annulus. The gas is pumped into the gas injection pipe and through a set of one or more gas injection ports into the drilling annulus. In embodiment of the present invention, the gas injection system includes the gas injection ports and one or more flow ports, which are disposed vertically below the gas injection ports in the borehole and which allow drilling fluids to flow between the gas injection annulus and the drilling annulus.

During the drilling process gas may flow between the drilling annulus and the gas injection pipe through a set of one or more flow ports. In the embodiment of the present invention, the set of one or more flow ports are a vertical distance below the set of one or more gas injection ports in the borehole, and the vertical distance is large enough such that when the gas is flowing from the gas injection pipe through the gas injection ports into the drilling annulus, the column of drilling fluids in the drilling annulus seals the flow ports and drilling fluid/gas is prevented from flowing from the gas injection annulus, through the flow ports into the drilling annulus. In aspects of the present invention, the sealing of the flow ports during gas injection, allows for controlling gas injection through the gas injection ports and, among other things, provides for dampening pressure and flow oscillations in the drilling system resulting from the gas injection.

In an embodiment of the present invention, an injection system for providing gas injection into a drilling annulus surrounding a drillstring during a drilling process is provided. The system is configured to provide for injection of gas into drilling annulus during a drilling process in order to control the BHP. The drilling system for the drilling process comprises a drillstring with a bottomhole assembly coupled with one end of the drillstring, The drill bit is used to bore through the formation to create the borehole. The drilling annulus comprises an annulus around the drillstring between a casing string and/or a wall of the borehole. Generally, lower down the borehole the drillstring is surrounded by the wall of the borehole whereas at higher locations in the borehole a casing string is sued to line the borehole.

The injection system comprises a gas injection pipe, which surrounds a section of the casing string so as to form a gas injection annulus between the casing string and the gas injection pipe. The injection system comprises a first set of one or more flow ports in the casing string that provide for flow drilling fluids between the drilling annulus and the gas injection annulus. The injection system comprises a first set of one or more gas injection ports in the casing string that allow gas that is pumped into the gas injection annulus to flow into the drilling annulus. In the embodiment of the present invention, the gas injection ports are disposed on the casing string a vertical distance above the first set of one or more flow ports. The flow ports comprise holes/perforations or the like in the casing string and these holes provide a certain opening, cross-sectional area through which the drilling fluid may flow. Similarly, the injection ports comprise holes/perforations or the like in the casing string and these holes provide a certain opening, cross-sectional area through which the gas may flow from the gas injection annulus into the drilling annulus. In an embodiment of the invention, the cross-sectional area of the flow ports is larger than the cross-sectional area of the injection ports. By positioning the injections ports above the flow ports in the borehole and by configuring the opening, cross-sectional areas of the injection ports to be less than the opening, cross-sectional areas of the flow ports, the injection system provides for gas injection into the drilling system during a drilling process where the pressure oscillations/flow oscillations in the drilling annulus/injection annulus are damped.

BRIEF DESCRIPTION OF THE DRAWINGS

The present disclosure is described in conjunction with the appended figures.

Figure 1:
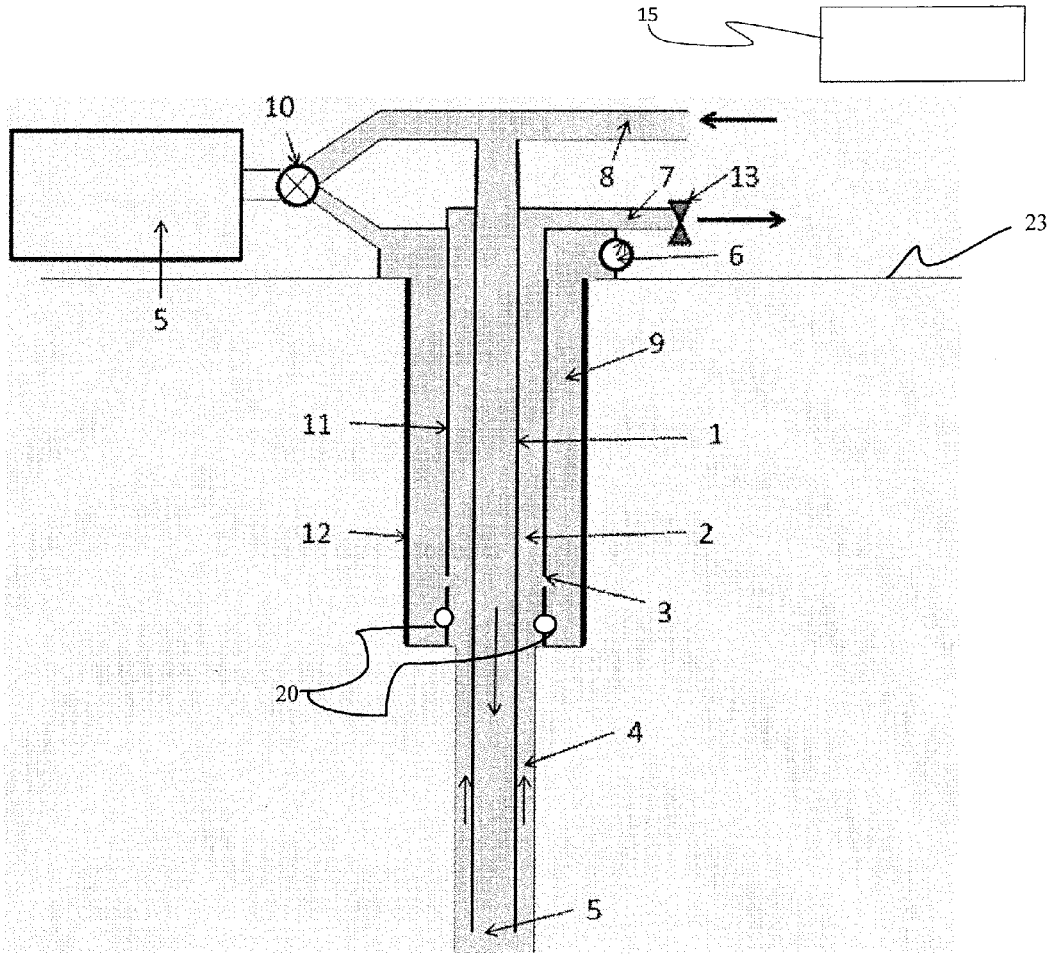
FIG. 1 illustrates a drilling system with a gas injection system, in accordance with an embodiment of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DESCRIPTION

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Managed pressure drilling ("MPD") is a drilling method that allows for reduction of the mud weight (for purposes of this application the terms "mud" and "drilling fluid" may be used interchangeably to refer to the fluid—which may for example be oil based, water based or the like—that is pumped down the drillstring during drilling) while retaining the ability to safely control initial reservoir pressures. MPD may be used to control the pressure during the drilling process to address the issues of kicks, loss of circulation of drilling fluid due to egress of the drilling fluid through fractures into the formation, formation fracturing, formation damage, or formation collapse. MPD may be particularly applicable when the formation pressure has fallen below the original formation pressure or a narrow operational window exists between the BHP at which the formation will fracture (the "fracture pressure") and the formation pressure.

In MPD, the annulus may be closed using a pressure containment device. This device comprises sealing elements, which engage with the outside surface of the drillstring so that flow of fluid between the sealing elements and the drillstring is substantially prevented, The sealing elements may allow for rotation of the drillstring in the borehole so that the drill bit on the lower end of the drillstring may be rotated. A flow control device may be used to provide a flow path for the escape of drilling fluid from the annulus. After the flow control device, a pressure control manifold with at least one adjustable choke or valve may be used to control the rate of flow of drilling fluid out of the annulus. When closed during drilling, the pressure containment device creates a backpressure in the wellbore, and this back pressure can be controlled by using the adjustable choke or valve on the pressure control manifold to control the degree to which flow of drilling fluid out of the annulus/riser annulus is restricted.

During MPD an operator may monitor and compare the flow rate of drilling fluid into the drillstring with the flow rate of drilling fluid out of the annulus to detect if there has been a kick or if drilling fluid is being lost to the formation. A sudden increase in the volume or volume flow rate out of the annulus relative to the volume or volume flow rate into the drillstring may indicate that there has been a kick. By contrast, a sudden drop in the flow rate out of the annulus/ relative to the flow rate into the drillstring may indicate that the drilling fluid has penetrated the formation.

In some MPD procedures, gas may be pumped into the annulus between the drillstring and the borehole wall (this annulus may be referred to as the "drilling annulus") in order to reduce bottomhole-pressure while drilling. Often, the borehole is lined with a pipe referred to as a casing string that may be cemented to the borehole wall to, among other things, stabilize the borehole and allow for flow of drilling fluids, production of hydrocarbons from the borehole and/or the like. In such aspects, the drilling annulus may be formed by the annulus lying between the drillstring and the casing string. In MPD, initiating the process of gas injection into the drilling annulus so that the BHP remains under control can be problematic as, among other things, it can produce large fluctuations in well pressure and achieving a steady-state in the borehole may take hours of unproductive time and/or require pumping large volumes of gas into the borehole. For example, if large gas injectors are used for gas injection, than large flows of drilling fluids may be produced between the gas injection pipe and the drilling annulus. Conversely, is small gas injectors are used, large pressures and gas volumes may be needed to force/inject the gas into the drilling annulus and these large pressures volumes may produce large oscillations in the pressure/flows in the drilling systems.

Annular gas injection is an MPD process for reducing the bottomhole-pressure in a well/borehole. In many annular gas injection systems, in addition to casing in the well, the casing being a tubing that lines the borehole and may in some cases be cemented to the wall of the borehole, there is a secondary annulus. This secondary annulus may be connected by one or more orifices at one or more depths to the primary annulus, through which the drilling fluids flow.

FIG. 1A illustrates the situation in a drilling system with a secondary/outer annulus before gas injection, in accordance with an embodiment of the present invention. As depicted, a drillstring (1) is suspended in a wellbore (4) (for purposes of this application the terms wellbore, borehole and well may be used interchangeable). In the upper section of the wellbore (4) there is an inner annulus (2) (also referred to as a drilling annulus) and a first casing string (11) that is hydraulically connected/in fluid communication with an outer annulus (9) through one or more orifices 3. The outer annulus (9) may itself be cased/lined by a second casing string (12).

In an embodiment of the present invention, the depicted concentric casing injection system is used to inject gas into the wellbore (4) that is being drilled through a subterranean formation. The concentric casing injection system comprises the outer annulus (9), which may also be referred to as a gas injection annulus, that surrounds the inner annulus (2), which may also be referred to as a drilling annulus, which drilling annulus is formed between the drillstring (1) disposed in the borehole and the first casing string (11) lining the borehole.

In some embodiments, the gas injection annulus comprises an annulus between the first casing string (11) the second casing string (12), which may be disposed concentrically around the first casing string (11). In one embodiment, gas is pumped into outer annulus (9) and through one or more gas injection ports 3 into the inner annulus (2). During, gas injection procedures, the concentric casing injection system may become/be unstable because of among other things the combination of the large volume and compliance of the gas in the outer annulus (9) along with the history dependent hydrostatic head of the inner annulus (2).

During conventional gas injection processes, oscillations in BHP of up to 2000 pounds-per-square-inch ("psi") with a period of more than two (2) hours have been recorded. The concentric casing injection system can be damped to prevent such large and/or long-duration oscillations by reducing the size/area of the one or more gas injection ports 3. However, restricting the size of the one or more gas injection ports 3 can make it almost impossible for the gas injection system to displace mud out of the outer annulus (9) and so gas injection into the inner annulus (2) may be prevented and/or restricted; for example it may take injection of large amounts of gas into the outer annulus (9) to displace the mud in the outer annulus (9) through small gas injection ports and this may lead to creating large pressure oscillations in the drilling system, which may require suspension of the drilling procedure.

In an embodiment of the present invention, drilling fluid (also referred to herein as drilling mud or mud) may be pumped from a pump(s) (not shown) through pipework (8) into the drillstring (1), down which it passes until it exits at a distal end (5), through a drill bit (not shown) or the like, before returning via the inner annulus (2) and return pipework (7) to fluid tanks for handling/preparing the drilling fluid. Between the pipework (7) and the fluid tanks (not shown) there may be chokes (13) and separators (not shown).

The outer annulus (9) and the pipes feeding the top of the drillstring are connected to gas pumps (5), via a valve manifold (10), which may direct gas either to the drillstring feed, to the outer annulus (9) or optionally to both at once. In some embodiments of the present invention, measurement of the pressure and other measurements may be made in the outer annulus (9), the inner annulus (2), the drillstring (1) and/or the like. In addition to the described equipment, there may be many other pieces of equipment at the surface, such as blow-out-preventers, a rotating-control-head, etc, which are normal with managed-pressure drilling, but which may not be involved in the procedure detailed here, and hence for clarity not shown.

In certain embodiments, the system may comprise one or more flow ports 20 between the outer annulus (9) and the inner annulus (2). The one or more flow ports 20 may allow drilling mud to flow between the inner annulus (2) and the outer annulus (9). For example, during the drilling process mud may be flowing in the inner annulus (2) and may flow through the one or more flow ports 20 into the outer annulus (9). In some embodiments of the present invention, the one or more gas injection ports 3 may be smaller than the one or more flow ports 20.

In one embodiment, the one or more gas injection ports 3 are disposed above, closer to a surface location 23, the one or more flow ports 20. In embodiments of the present invention, the one or more gas injection ports 3 and the one or more flow ports 20 may be separated by distances of the order of hundreds of feet. In such embodiments, it has been found that even though separated by large distances, the one or more gas injection ports 3 and the one or more flow ports 20 affect one another's operation during the gas injection process. In embodiments of the present invention, this interoperability is harnessed to provide for gas injection without creating large pressure and/or flow oscillations in the drilling system. Moreover, the interoperability of the widely separated one or more gas injection ports 3 and the one or more flow ports 20, allows for customizing the properties of the one or more gas injection ports 3 to provide for improved/efficient gas injection, i.e. gas injection that does not require large volumes of gas and/or high gas pressures.

In aspects of the present invention, the separation between the one or more gas injection ports 3 and the one or more flow ports 20 is selected such that the hydrostatic head between the one or more gas injection ports 3 and the one or more flow ports 20 ensures a hydrostatic seal that closes the one or more flow ports 20 to drilling fluid/gas flow and provides that the gas flows through the outer annulus (9) and into the inner annulus (2) through the one or more gas injection ports 3; rather than also flowing through the one or more flow ports 20.

Once the gas is flowing through the one or more gas injection ports 3, although the one or more flow ports 20 are effectively sealed there may be some mud flow between the outer annulus (9) and the inner annulus (2) and this flow may dampen the oscillations of the drilling fluid/drilling mud when the gas is being injected and may stabilize the concentric casing injection system. However because the one or more flow ports 20 are effectively sealed to gas flow, the size of the one or more gas injection ports 3 may be small as the gas flow is constrained to flowing through the one or more gas injection ports 3 and drilling fluid may be displaced through the one or more flow ports 20 (rather than through the one or more gas injection ports 3 with the gas), which one or more flow ports 20 may be larger in cross-sectional dimension than the smaller one or more gas injection ports 3; in certain aspects, use of small gas injection ports serves to reduce oscillations developed in the mud when the gas is injected in to the system.

Merely by way of example, in some embodiments the one or more gas injection ports (3) are disposed at least fifty (50) feet above the one or more flow ports 20. Merely by way of example, in some embodiments the one or more gas injection ports (3) are disposed between 50 feet and one hundred (100) feet above the one or more flow ports 20. Merely by way of example, in some embodiments the one or more gas injection ports (3) are disposed at least one hundred (100) feet above the one or more flow ports 20. Merely by way of example, in some embodiments the one or more gas injection ports (3) are disposed at least 100-150 feet above the one or more flow ports 20. Merely by way of example, in some embodiments the one or more gas injection ports (3) are disposed at least 150-200 feet above the one or more flow ports 20. Merely by way of example, in some embodiments the one or more gas injection ports (3) are disposed at least 200-250 feet above the one or more flow ports 20. Merely by way of example, in some embodiments the one or more gas injection ports (3) are disposed at least 250-300 feet above the set of one or more flow ports 20. Merely by way of example, in some embodiments the one or more gas injection ports (3) are disposed at least 300-350 feet above the one or more flow ports 20. Merely by way of example, in some embodiments the one or more gas injection ports 3 are disposed at least a 350-400 feet above the one or more flow ports 20. Merely by way of example, in some embodiments the one or more gas injection ports 3 are disposed at least 400-500 feet above the one or more flow ports 20. In other embodiments, the separation of the gas injection ports and the flow ports may be of the order of hundreds and even thousands of feet.

In embodiments of the present invention, it has been found that a 50 foot separation of the one or more gas injection ports 3 and the one or more flow ports 20 is sufficient to provide for sealing the one or more flow ports 20 when gas is being injected through the one or more gas injection ports 3 into the inner annulus 2. Greater separation may provide for use of larger cross-sectional areas of the one or more gas injection ports 3 and/or the one or more flow ports 20, larger volumes of gas, greater gas pressures and/or the like, but larger separations may not be practicable because of the configuration of the gas injection system. In some aspects, a separation of 100 feet or greater between the one or more gas injection ports 3 and the one or more flow ports 20 may be used to ensure sealing of the flow ports 20 under different conditions, such as different mud weights or the like, since in many aspects of the present invention, once the separation of the one or more gas injection ports 3 and the one or more flow ports 20 is set, it cannot be easily altered.

The separation between the one or more gas injection ports 3 and the one or more flow ports 20 that is used to provide for sealing the one or more flow ports 20 by way of the hydrostatic head is a function of the properties of the drilling fluid/drilling mud, the size of the one or more flow ports 20, the properties of the gas being injected, the volume/pressure of the gas being injected, the size of the gas injection ports 3 and/or the like. In some embodiments, one or more of these factors is used to determine the desired shape, size and separation of the one or more gas injection ports 3 and the one or more flow ports 20. Additionally, the outer annulus (9) may also be configured based upon the determination of the size., shape and relative distribution of the one or more gas injection ports 3 and/or the one or more flow ports 20. In an embodiment of the present invention, once the gas injection has commenced/is under way, the pressure drop across the two sets of ports is of the order of only a few pounds per square inch ("psi"), this low pressure drop may allow for flow of drilling fluid/drilling mud between the inner annulus (2)and the outer annulus (9), which may dampen oscillations in the drilling system during the gas injection.

In accordance with an embodiment of the present invention, the drill pipe, (1) the inner annulus (2) and the outer annulus (9) are initially full of drilling mud with a choke (13) fully open. The mud pumps (not shown) are started and the mud is circulated slowly through the drillstring (1), the bit on the end of the drillstring and the inner annulus (2) with the choke (13) fully open. In aspects of the present invention, this flow serves to break the gel strength of the mud, while minimizing the frictional pressure drop. In an embodiment of the present invention, gas injection into the outer annulus (9) is started to displace the mud from this section through the one or more gas injection ports 3. As the gas-mud interface reaches the one or more gas injection ports 3, the mud circulation rate is increased to its full value, as is the gas injection rate. Under these conditions, in accordance with an embodiment of the present invention, gas flows with a small pressure drop through the one or more gas injection ports 3. In accordance with an embodiment of the present invention, the hydrostatic head difference between the one or more gas injection ports 3 and the one or more flow ports 20 limits further displacement of mud from the outer annulus (9) and ensures the gas only flows through the smaller upper ports. As the gas starts to rise in the inner annulus (2)the choke is closed slightly to control the BHP. The choke is further adjusted as the inner annulus (2) reaches a steady state with constant gas/mud flow.

In some embodiments, a processor 15 or the like may be used to control the chokes, pumps and/or the like to control the flow of gas into the drilling system. The processor 15 may also be used to process mud properties, such as density of the like that will provide the desired hydrostatic head given a defined vertical separation of the one or more gas injection ports 3 and the one or more flow ports 20. Where the one or more gas injection ports 3 and/or the one or more flow ports 20 comprise nozzles or valves the processor may control the operation/characteristics (i.e. size, orientation and/or the like) of the gas injection and/or the flow ports. Use of a processor may provide for intelligent gas injection into the drilling system.

Figure 2A:
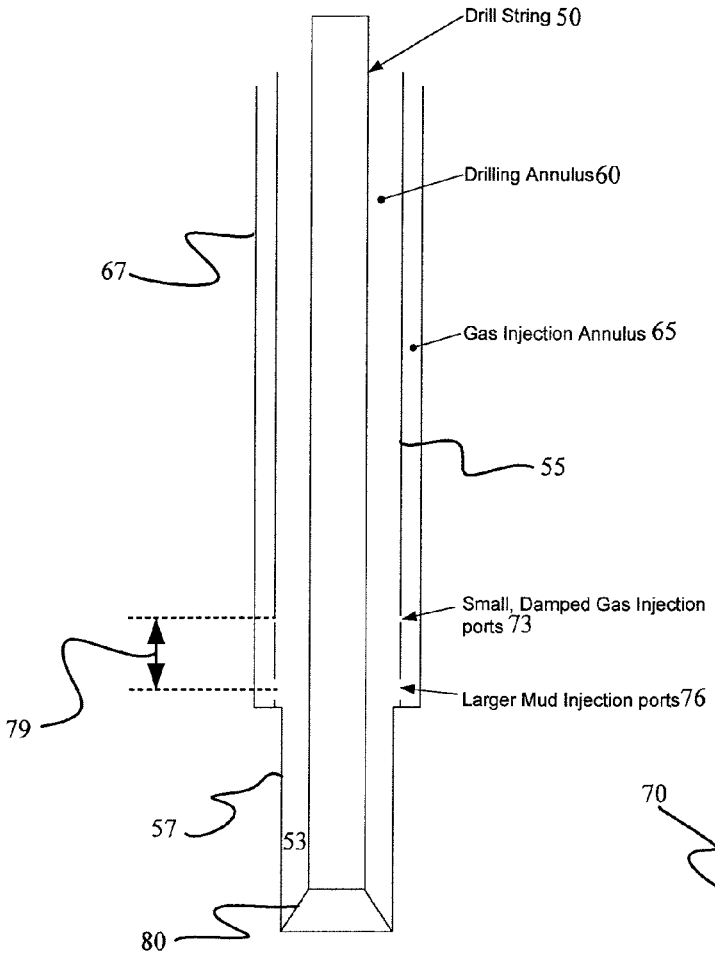
FIG. 2A illustrates a concentric gas injection system for managed pressure drilling, in accordance with one embodiment of the present invention.

FIG. 2A illustrates a concentric gas injection system for managed pressure drilling, in accordance with one embodiment of the present invention. As depicted, a drillstring 50 extends into a borehole 53 and creates a drilling annulus 60 between the drillstring 50 and an inner-wall 57 of the borehole 53. At the lower end of the drillstring 50 a drill bit 80 is used to drill the borehole 53 through an earth formation.

In an embodiment, the inner-wall 57 is at least partially cased with a casing string 55. Surrounding the drilling annulus 60 is a gas injection annulus 65 that may also be cased with a second casing string 67. One or more gas injection ports 73 provide fluid communication between the drilling annulus 60 and the gas injection annulus 65. Additionally, at a location further downhole along the casing string 57, one or more mud ports 76 provide fluid communication between the drilling annulus 60 and the gas injection annulus 65. The one or more mud ports 76 are positioned a vertical distance 79 below the one or more gas injection ports 73. In an embodiment of the present invention, the vertical distance 79 is configured such that when gas is injected into the drilling annulus 60, the column of drilling fluid in the drilling annulus 60 that extends upwards from the one or more mud ports 76 is tall enough to seal the one or more mud ports 76 to gas flow.

In some embodiments of the present invention, and as depicted in FIG. 2A, the mud ports 76 are larger than the gas injection ports 73, i.e. the one or more mud ports 76 have a larger cross-sectional area/opening area through which fluids (gas/liquid) can flow than the one or more gas injection ports 73. In accordance with embodiments of the present invention, the use of the combination of the gas injection ports 73 and the mud ports 76 damps oscillations produced in the drilling mud flowing in the drilling annulus 60 when gas is injected through the gas injection annulus 65 into the drilling annulus 60. Furthermore, the use of small gas injection ports 73 and larger mud flow ports 76 may provide for damping mud oscillations when gas is injected through the gas injection annulus into the drilling annulus. In accordance with an embodiment of the present invention, the vertical separation of the gas injection ports 73 and the mud ports 76 is configured such that in use the hydrostatic head of the drilling mud between the gas injection ports 73 and the mud injection ports 76 is sufficient to seal the mud ports 73 to gas flow. This sealing of the mud ports 76 provides that the injected gas only flows from the injection annulus 65 into the drilling annulus 60 through the gas injection ports 73.

In embodiments of the present invention, the concentric casing gas injection provides a method for reducing the effective circulating density ("ECD") of the mud below that of a single phase fluid, such as a single phase drilling fluid or drilling mud. In certain embodiments of the present invention, by injecting mud into the drilling annulus through the one or more gas injection ports 73, a liquid column of drilling fluid/drilling mud may be maintained in the drillstring 50 during the gas injection process. By maintaining such a liquid column, telemetry processes associated with measurements made while drilling, logging while drilling and/or the like are not interfered by the gas injection process.

Certain embodiments of the present invention provide for using a plurality of ports between the drilling annulus 60 and the injection annulus 65. In certain aspects, two sets of ports are used a set of gas injection ports and a set of flow ports. In such embodiments, the gas injection ports are disposed above the flow ports, i.e. between the flow ports and an Earth surface. In other aspects, more than two sets of ports may be used, with the different sets of ports each disposed at different vertical locations along the gas injection annulus/drilling annulus. In certain embodiments, the gas injections ports are smaller than the flow ports. The gas injection ports are configured to maintain a large pressure drop and dampen oscillations when gas is injected through the gas injection annulus into the drilling annulus. In certain embodiments, the flow ports are larger than the gas injection ports and are configured to allow displacement of drilling fluid/drilling mud between the gas injection annulus and the drilling annulus when gas is injected through the gas injection annulus into the drilling annulus. As such, the combination of the gas injection ports and the flow ports provides for damping oscillations that occur when gas is injected into the drilling annulus.

The separation of the phases—the gas phase and the drilling fluid phase—is achieved by vertical separation of the gas injection ports and the flow ports. Merely by way of example, a typical pressure drop for a gas injection flow is about 5-10 psi. The hydrostatic head of a drilling fluid/drilling mud with a specific gravity ("SG") equal to one (1) is about 0.5 psi per vertical foot of the drilling fluid/drilling mud in the annulus. In embodiments of the present invention, by separating the gas injection ports by more than 50 feet, between 50 feet and a 100 feet or more than 100 feet, the drilling fluid/drilling mud can flows through the lower ports, but when only gas is injected through the gas injection annulus, the column of the drilling fluid/drilling mud between the gas injection ports and the flow ports provides that the gas only flows through the gas injection ports. While 50 feet has been found to be enough of a separation between the gas injector ports and the flow ports to provide for sealing the flow ports to gas flow, larger separations may provide for use of smaller gas injectors, pumping of larger volumes of gas, use of higher pumping pressures for the gas, use of larger flow ports and/or the like.

In some embodiments of the present invention, the orifices between the outer and inner annuli, the gas injection annulus and the drilling annulus may not be simple orifices, but may be more complicated arrangements of nozzles, non-return-valves or any other means of allowing gas to move from the outer to the inner annulus when the pressure in the outer annulus exceeds the pressure in the inner annulus at the depth of the nozzle. In some embodiments of the present invention, instead of a gas injection annulus, a pipe or the like, such as coiled tubing may be used to inject the gas into the drilling annulus. In some aspects, the size of the gas injector ports/flow ports and or opening/closing of the gas injector ports/flow ports may be controlled by a processor so as to manage the gas injection into the drilling annulus.

Figure 2B:
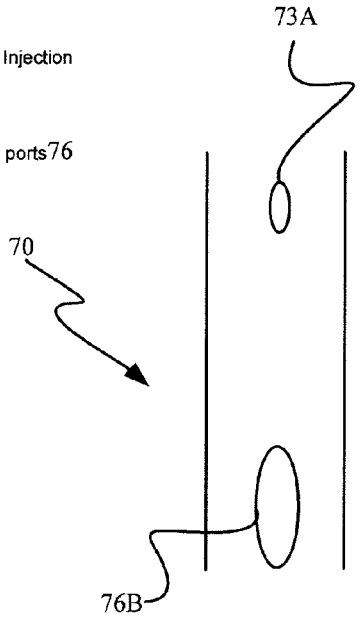
FIG. 2B illustrates a gas injection pipe for use in MPD, in accordance with an embodiment of the present invention.

FIG. 2B illustrates a gas injection pipe for use in MPD, in accordance with an embodiment of the present invention. In one embodiment of the present invention, a gas injection pipe 70 may be used to inject gas into the drilling annulus. The gas injection pipe may comprise coiled tubing or the like. The gas injection pipe 70 comprises a plurality of gas inject injector ports 73A disposed above a plurality of flow ports 76B; where the gas injection pipe 70 is disposed down a wellbore with the gas inject injector ports 73A positioned above the flow ports 76B, i.e., between the flow ports 76B and a surface location.

Figure 3:
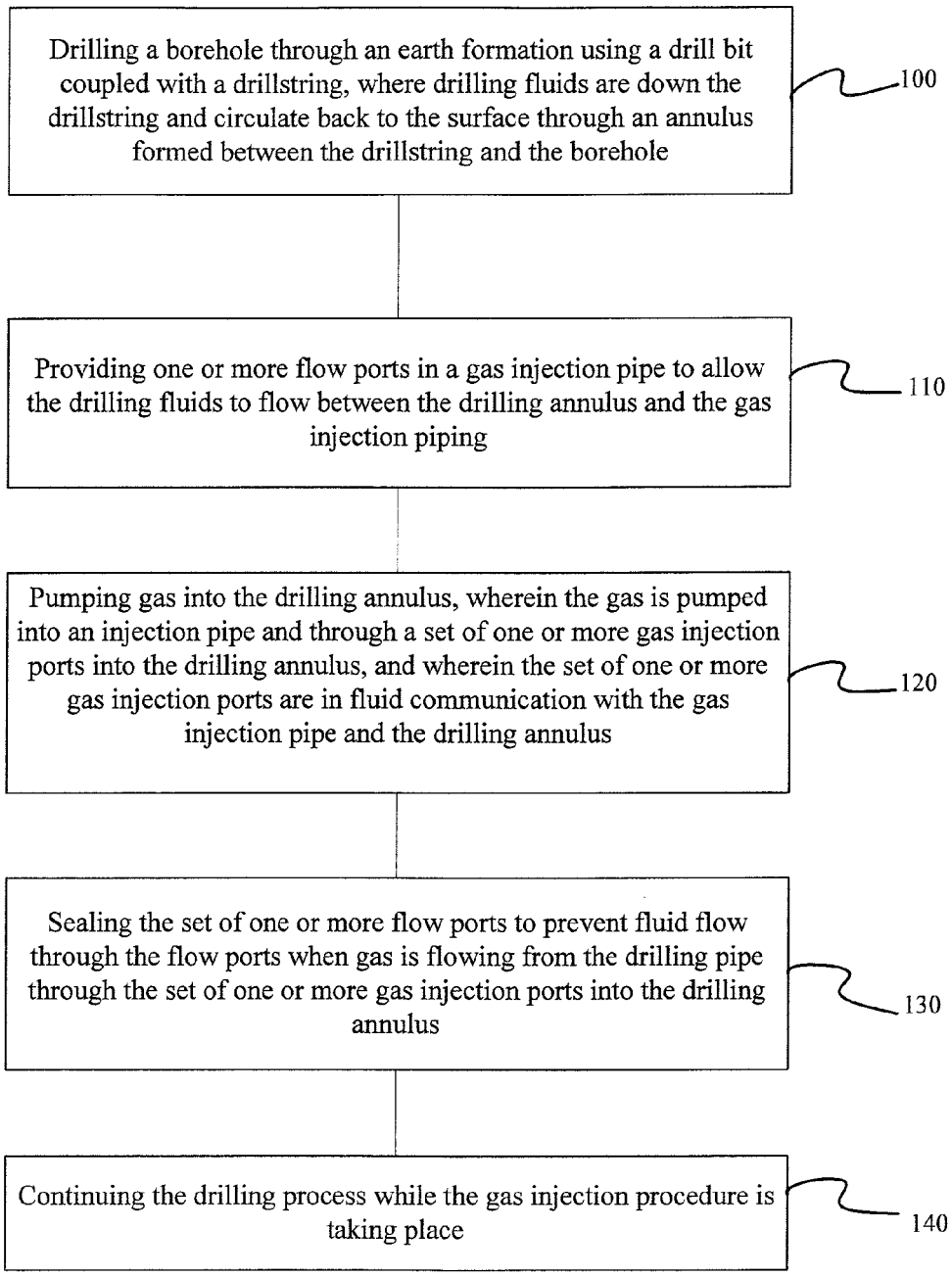
FIG. 3 is a flow-type illustration of gas injection for managed pressure drilling during a drilling procedure in accordance with an embodiment of the present invention.

FIG. 3 is a flow-type illustration of gas injection for managed pressure drilling during a drilling procedure in accordance with an embodiment of the present invention. In step 100 a drilling process is incurring whereby a drillstring coupled with a drill bit is being used to drill a borehole through an earth formation. The drillstring extends from a surface location down the borehole. Drilling fluid is pumped down the drillstring during the drilling process and circulates back to the surface via an annulus formed between the outer surface of the drillstring and the inner-wall of the borehole. The drilling fluid may be used to hydraulically power the drill bit, transport cuttings away from the drill bit and/or the like.

In step 110, the drilling fluid is allowed to flow between the drilling annulus and a gas injection pipe through a plurality of flow ports. In certain aspects, the top portion of the drilling annulus is lined by a casing string, such that the drilling annulus is formed by an annular space between the drillstring and the casing string. The flow ports may comprise openings in the casing string through which the drilling fluid may flow between the cased drilling annulus and the gas injection pipe. In some embodiments, the gas injection pipe is configured to concentric with the casing string and the gas injection pipe creates a gas injection annulus between the casing string and the gas injection pipe, which itself may be a casing string. In some embodiments, the gas injection pipe may be a pipe that is extended down the drilling annulus and the flow ports may be openings in the lower end of the gas injection pipe.

In step 120 gas is pumped into the top of the drilling annulus. The gas is pumped into the top of the drilling annulus through the gas injection pipe, which includes gas injection ports through which the gas flows from the gas injection pipe into the drilling annulus. In certain aspects, the top portion of the drilling annulus is lined by a casing string such that the drilling annulus is formed by an annular space between the drillstring and the casing string. In some embodiments, the gas injection pipe is configured to be concentric with the casing string and the gas injection pipe creates a gas injection annulus between the casing string and the gas injection pipe, which itself may be a casing string. In other embodiments, the gas injection piping may be a pipe that is disposed in the drilling annulus and includes the flow ports and the gas injector ports. In embodiments of the present invention, the gas injection ports are disposed at a location that is vertically higher in the borehole than the flow ports.

In step 120, the gas is injected from the gas injection pipe into the drilling annulus via a plurality of gas injector ports. The gas injector ports may comprise openings in the casing string that allow the gas to flow from the gas injection pipe into the drilling annulus. Pumps may be used to pump a volume of gas at a pressure into the gas injection pipe. As gas is pumped into the gas injection pipe, drilling fluid may be pushed out of the gas injection pipe into the drilling annulus through the flow ports. As gas is pumped into the gas injection pipe, drilling fluid in the gas injection pipe may be compressed, forced to flow through the flow ports and/or the like and the gas may, after a period of pumping, extend down the gas injection pipe to the gas injection ports. When the gas reaches the gas injection ports it may pass through the ports into the drilling annulus. After a period of pumping, the gas may circulate down the gas injection pipe, through the gas injection ports , into the drilling annulus and up to the surface. By introducing gas into the top of the drilling annulus the BHP may be controlled/reduced. A processor may be used to control the pumping of the gas into the top of the drilling annulus so as to produce a desired/required BHP. Sensors in the drilling annulus, gas injection pipe, at the bottom of the borehole, in the formation and/or the like may be coupled with the processor to provide for active management of the gas injection process to produce a desired/required BHP.

In step 130, the flow ports are sealed when the gas is flowing between the gas injection pipe and drilling annulus through the gas injector ports. In an embodiment of the present invention, the gas injection ports and the flow ports are separated by a vertical distance such that the hydrostatic head of the drilling fluid in the drilling annulus seals the flow ports when gas is flowing from the gas injection pipe into the drilling annulus through the gas injector ports. The vertical separation distances may be greater than 50 feet, greater than 100 feet, greater than 200 feet, greater than 300 feet depending upon the weight of the drilling fluid, the size of the flow ports, the size of the gas injector ports and/or the like.

In an embodiment of the present invention, the size of the flow ports is greater that the size of the gas injector ports. In an embodiment of the present invention, small gas injector ports are used to provide for efficient/effective injection of gas into the drilling annulus. Large gas injection ports require use of large pumping pressures to push the gas into the drilling annulus with the possibility of drilling fluid flowing through the gas injector ports. Large flow ports allow for drilling fluid flow between the drilling annulus and the gas injection pipe. When gas is initially pumped into the gas injection pipe, allowing the gas to be pushed by the gas into the drilling annulus through the flow ports may allow for use of lower gas pumping pressures in order to pump the gas down the gas injection pipe to the gas injector ports. Lowering of gas pumping pressures, gas pumping volumes and/or the like in the gas injection pipe means that oscillations in the drilling fluid in the drilling annulus/gas injector pipe, such as pressure and flow oscillations, resulting from the gas injection are reduced.

In step 140, the drilling process may be continued while the gas injection process occurs. In some aspects, the drilling process may be continued after the gas injection process has either finished or is in a steady state. By injecting gas into the top of the drilling annulus, the flow of a column of drilling fluid in the drillstring is not affected and processes such as telemetry may be performed in this column. Additionally, because the column of drilling fluid in the drillstring is not affected by the gas injection, the drilling process may be effectively continued during at least a portion of the gas injection procedure.

While the principles of the disclosure have been described above in connection with specific apparatuses and methods, it is to be clearly understood that this description is made only by way of example and not as limitation on the scope of the invention.

What is claimed is:

1. A method for injecting gas into a drilling annulus surrounding a drillstring during a drilling process for drilling a borehole into a subterranean formation, where the drilling annulus comprises an annular space between the drillstring string and a casing string and the drillstring extends from a surface location down the borehole, the method comprising:

pumping gas into the drilling annulus, wherein the gas is pumped into an injection pipe and through a set of one or more gas injection ports into the drilling annulus, and wherein the set of one or more gas injection ports are in fluid communication with the gas injection pipe and the drilling annulus;

flowing drilling fluids between the drilling annulus and the gas injection pipe through a set of one or more flow ports, wherein the set of one or more flow ports are in fluid communication with the gas injection pipe and the drilling annulus, and wherein the set of one or more flow ports are a vertical distance below the set of one or more gas injection ports such that the set of gas injection ports are located between the set of one or more flow ports and the surface location; and using a hydrostatic head of a column of drilling fluids extending between the set of one or more flow ports and the set of one or more gas injection ports to seal the set of one or more flow ports when gas is flowing from the drilling pipe through the set of one or more gas injection ports into the drilling annulus.

2. The method of claim 1, wherein the step of using the hydrostatic head of the column of drilling fluids to seal the set of one or more flow ports when gas is flowing from the drilling pipe through the set of one or more gas injection ports into the drilling annulus prevents the gas from flowing through the flow ports.

3. The method of claim 1, wherein the vertical distance is more than fifty (50) feet.

4. The method of claim 1, wherein the vertical distance is more than one hundred (100) feet.

5. The method of claim 1, wherein the vertical distance is between one hundred (100) feet and two hundred (200) feet.

6. The method of claim 1, wherein the vertical distance is between one hundred (100) feet and three hundred (300) feet.

7. The method of claim 1, wherein the vertical distance is more than three hundred (300) feet.

8. The method of claim 1, wherein:

the set of one or more gas injection ports comprise an injection cross-sectional area through which fluid can flow from the injection pipe into the drilling annulus;

the set of one or more flow ports comprise a flow cross-sectional area through which fluid can flow between the injection pipe and the drilling annulus; and the injection cross-sectional area is less than the flow cross-sectional area.

9. The method of claim 8, wherein the flow cross-sectional area is at least ten (10) times larger than the injection cross-sectional area.

10. The method of claim 8, wherein the flow cross-sectional area is between ten (10) and fifty (50) times larger than the injection cross-sectional area.

11. The method of claim 8, wherein the flow cross-sectional area is between fifty (50) and one hundred (100) times larger than the injection cross-sectional area.

12. The method of claim 8, wherein the flow cross-sectional area is greater than one hundred (100) times larger than the injection cross-sectional area.

13. The method of claim 1, wherein the gas injection pipe comprises a gas injection annulus formed between the casing string and a second casing string disposed around the casing string.

14. The method of claim 13, wherein the set of one or more gas injection ports and the set of one or more flow ports comprise openings in the casing string.

15. The method of claim 1, wherein the gas injection pipe comprises coiled tubing.

16. The method of claim 1, wherein at least one of the set of one or more gas injection ports or at least one of the set of one or more flow ports is closed to provide that the vertical distance between the set of one or more flow ports and the set of one or more gas injection ports is sufficient to provide that the hydrostatic head of the drilling fluid column seals flow of the drilling fluid through the flow ports when the gas is flowing through the set of one or more gas injectors into the drilling annulus.

17. The method of claim 1, wherein the vertical distance is determined using at least one of experimentation, modeling, prior experience and calculation.

18. The method of claim 1, wherein a size of the gas injection ports is determined using at least one of experimentation, modeling, prior experience and calculation.

19. The method of claim 1, wherein a size of the flow ports is determined using at least one of experimentation, modeling, prior experience and calculation.

20. A system for providing gas injection into a drilling annulus surrounding a drillstring during a drilling process for drilling a borehole into a subterranean formation, where the drilling annulus comprises an annular space between the drillstring string and a casing string and the drillstring extends from a surface location down the borehole, the method comprising:

a gas injection pipe, wherein the gas injection pipe comprises a gas injection annulus formed between the casing string and a second casing string disposed around the casing string;

a first set of one or more flow ports in the casing string configured to provide fluid communication between the drilling annulus and the gas injection annulus; and a first set of one or more gas injection ports in the casing string configured to provide fluid communication between the drilling annulus and the gas injection annulus, wherein:

the first set of gas injection ports are disposed on the casing string a vertical distance above the first set of one or more flow ports the first set of gas injection ports are located between the first set of one or more flow ports and the surface location;

the first set of one or more flow ports produce flow openings in the casing string having a first total cross-sectional area;

the first set of one or more gas injection ports produce injection openings in the casing string having a second total cross-sectional area; and the first total cross-sectional area is at least ten (10) times larger than the second total cross-sectional area.

21. The system of claim 20, wherein the vertical distance is configured to provide that in use during the drilling process, drilling fluid in the injection annulus seals the first set of one or more flow ports preventing flow of drilling fluids between the drilling annulus and the injection annulus when gas is flowing from the injection annulus through the first set of one or more injection ports into the drilling annulus.

22. The system of claim 21, wherein the vertical distance is greater than fifty (50) feet.

23. The system of claim 21, wherein the vertical distance is greater than one hundred (100) feet.

24. The system of claim 21, wherein the vertical distance is between one hundred (100) feet and two hundred (200) feet.

25. The system of claim 21, wherein the vertical distance is between one hundred (100) feet and three hundred (300) feet.

26. The system of claim 21, wherein the vertical distance is more than three hundred (300) feet.

27. The system of claim 20, wherein the first total cross-sectional area is between ten (10) and fifty (50) times larger than the second total cross-sectional area.

28. The system of claim 20, wherein the first total cross-sectional area is between fifty (50) and one hundred (100) times larger than the second cross-sectional area.

29. The system of claim 20, wherein the first total cross-sectional area is greater than one hundred (100) times larger than the second total cross-sectional area.

30. The system of claim 20, further comprising a sensor configured to detect when gas is flowing through the first set of one or more injection ports.

* * * * *